United States Patent [19]

Paterson, deceased et al.

[11] 4,046,044

[45] Sept. 6, 1977

[54] PAPER TRIMMERS

[76] Inventors: Donald MacDougal Paterson, deceased, late of London, England; by Alexander Robertson Brackenridge, executor, 2-6 Boswell Court, London WC1N 3PS, England

[21] Appl. No.: 633,672

[22] Filed: Nov. 20, 1975

[30] Foreign Application Priority Data

Nov. 26, 1974 United Kingdom ..... 51138/74

[51] Int. Cl.[2] ..... B26D 1/20

[52] U.S. Cl. ..... 83/489; 83/468; 83/508; 83/522

[58] Field of Search ..... 83/485, 489, 455, 468, 83/508, 522, 614, 472

[56] References Cited

U.S. PATENT DOCUMENTS

| | | | |
|---|---|---|---|
| 532,822 | 1/1895 | Saltzkorn et al. | 83/455 X |
| 855,301 | 5/1907 | Gobie | 83/485 X |
| 1,735,520 | 11/1929 | Williams | 83/485 |
| 1,981,866 | 11/1934 | King | 83/455 |
| 2,219,485 | 10/1940 | Neuwirth | 83/489 X |
| 2,266,629 | 12/1941 | Flynn | 83/614 X |
| 3,447,409 | 6/1969 | Lewis | 83/485 |
| 3,766,816 | 10/1973 | Loveless | 83/489 |

FOREIGN PATENT DOCUMENTS

| | | | |
|---|---|---|---|
| 719,649 | 3/1942 | Germany | 83/485 |

*Primary Examiner*—Frank T. Yost
*Attorney, Agent, or Firm*—Darby & Darby

[57] ABSTRACT

A paper trimmer is described comprising a base board and a fixed blade set in one edge of the board, the improvement comprising a guide rail mounted above and closely spaced from the cutter blade and a carriage mounted on the guide rail, the carriage containing a cutter wheel abutting the fixed blade and adapted to be turned, as the carriage is slid on the guide, by engagement of a friction drive wheel coaxial with the cutter wheel on the upper surface of the guide rail.

4 Claims, 4 Drawing Figures

PAPER TRIMMERS

This invention relates to paper trimmers.

Many types of apparatus are known for trimming paper, the most well known probably being the standard guillotine. In a standard guillotine, a base board on which paper is to be cut has one edge formed as a square cut hard metal blade. Pivotally secured to that edge is a second metal blade cooperating therewith in the manner of a pair of scissors which may be brought down to cut off any paper projecting over the edge of the fixed blade. There are several varieties of such guillotines commercially available and they have been known for decades.

In recent years rotary paper trimmers have been developed which retain the fixed blade along the edge of a board but which replace the expensive pivotal blade with a rotating cutter wheel. The rotating cutter wheel is caused to travel along the edge of the fixed blade bearing against it as it does so and this accordingly cuts by scissors action any paper projecting over the edge of the fixed blade. Cutters of this type are described in British Patent Specification Nos. 1247681 and 1334854.

A disadvantage of the paper trimmers described in the British Patent Specifications just referred to resides in the necessity of providing a guide bar along which the carriage bearing the rotary cutting wheel may run. This guide bar must of necessity be straight and accurately parallel with the fixed blade.

According to the present invention there is provided a paper trimmer comprising a base board, a fixed blade set in one edge of the board, a guide rail mounted above and closely spaced from the cutter blade and a carriage mounted on the guide rail, the carriage containing a cutter wheel abutting the fixed blade and adapted to be turned, as the carriage is slid on the guide, by engagement of a friction drive wheel coaxial with the cutter wheel on the upper surface of the guide rail.

Preferably the guide rail and carriage are held together by a key-configuration, e.g. a dovetail. Preferably the cutter wheel and the drive wheel are on opposite sides of a journal formed in the carriage to support the assembly of drive wheel and cutter wheel.

In a particularly preferred feature, the assembly of cutter and drive wheel may be angularly displaceable to ensure that as the carriage is moved along the guide rail, the forward edge of the cutting wheel abuts the cutter blade. The amount of angular movement need only be a few degrees in order to ensure that as the carriage is moved forward, the blade edge of the cutter wheel "toes in" to the cutter blade. The tracking edge of the cutter wheel is then out of contact with the cutter blade, which reduces wear.

Preferably in such an arrangement means are included to bias the assembly of cutter and drive wheel into one of two positions, angularly symmetrical with respect to a plane perpendicular to the cutting edge of the cutting blade.

The invention is illustrated by way of example, with reference to the accompanying drawings in which.

Figure 1:
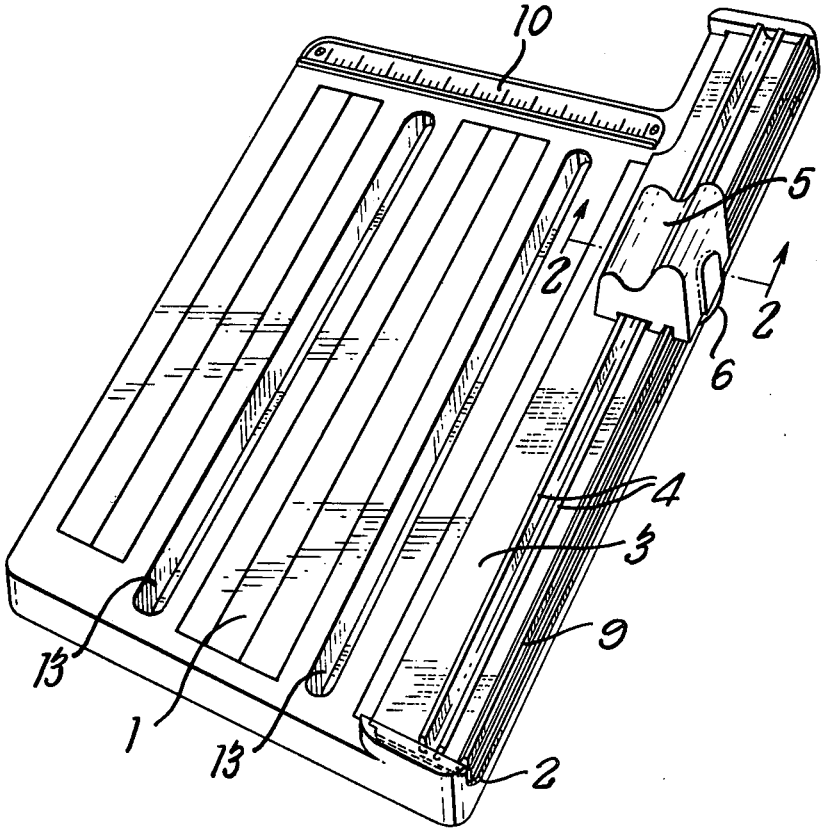
FIG. 1 is a perspective view of a paper trimmer according to the invention.
Figure 2:
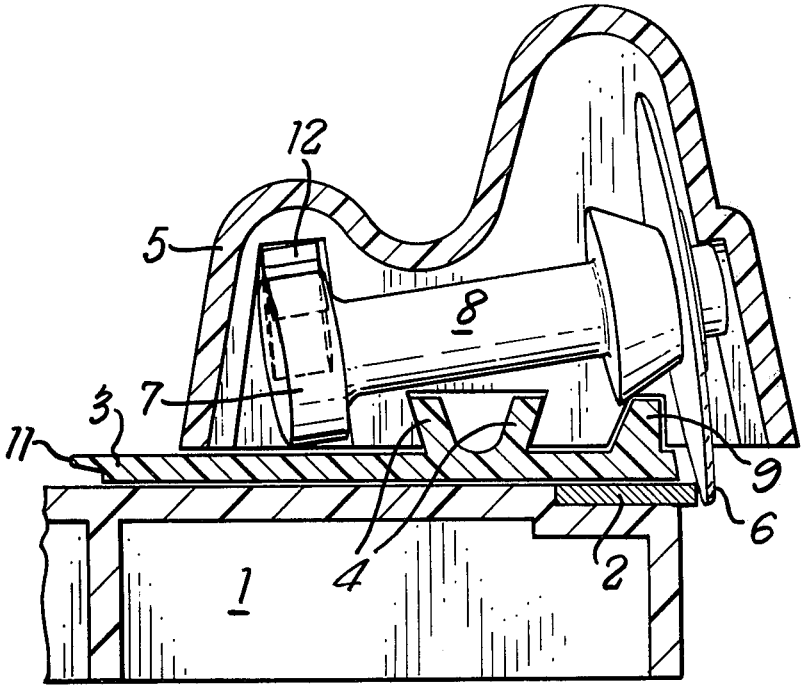
FIG. 2 is a section along the lines 2—2 of FIG. 1.

Referring to the drawings, the trimmer consists of a base board 1 in the edge of which is set a steel blade 2. Supported above blade 2 and spaced a little way therefrom (to allow insertion of paper to be trimmed) is a tranparent plastic guide rail 3 having a chamfered edge 11 to facilitate paper insertion. Engaged on a dovetail portion 4 of rail 3 is a carriage housing 5. Inside carriage housing 5 is an assembly of a metal cutter wheel 6, drive wheel 7 and stubshaft 8. Shaft 8 is journalled at its end remote from wheel 7 in a part of the carriage housing 5. Wheel 7 is made of suitable frictional material, and is pressed into contact with rail 3 by means of a spring 12 located in the housing. As the carriage is slid up and down rail 3, wheel 6 executes a scissors cutting action along blade 2 and cuts through any paper projecting over the edge. Wheel 6 is held biased against blade 2 during use by the action of an upstanding rib 9 on rail 3 on part of shaft 8, this action of the rib 9 on shaft 8 serving to incline the axis of rotation of the cutter blade at an acute angle relative to the plane of board 1.

Figure 3:
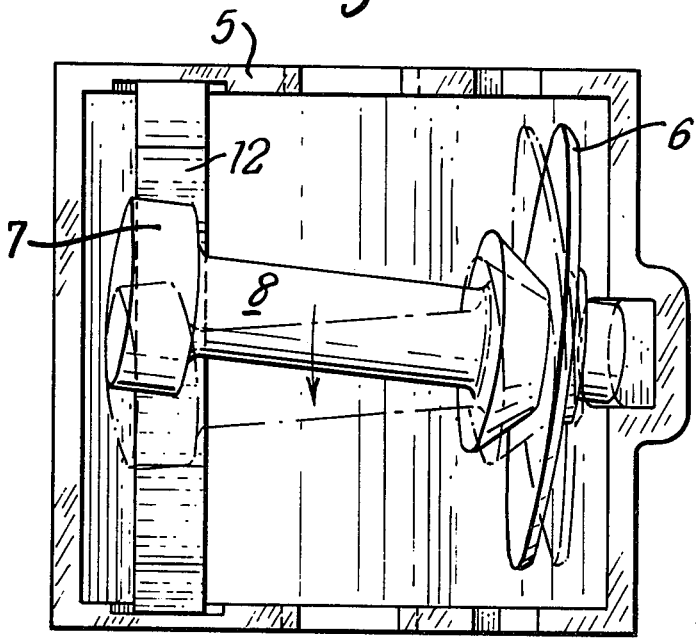
FIG. 3 is an under plan view of the cutter head.
Figure 4:
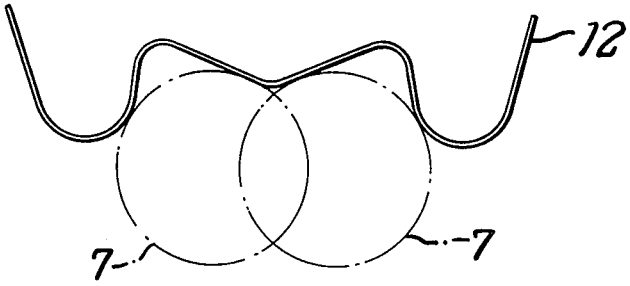
FIG. 4 is a view of a spring and part of a stubshaft.

Spring 12 has two depressed areas into which the wheel 7 may locate and dependent on which the cutter wheel assembly will be in the position shown in FIG. 3 in dashed or in full lines. As the housing 5 is moved, wheel 7 takes up that one of the two positions shown in FIGS. 3 and 4 where the wheel 7 is trailing. This causes the leading edge of cutter wheel 6 to "toe in" to cutter blade 2, thus ensuring clean cutting and minimising wear.

The paper to be trimmed may be trimmed at a right angle by butting one edge of the paper against a rule 10 set on base 1 in known fashion. Sunk in base 1 are two grooves 13 to faciliate lifting paper from the base.

I claim:

1. In a paper trimmer comprising a base board and a fixed cutter blade set in one edge of the board, the improvement comprising a guide rail mounted above and closely spaced from the cutter blade and a carriage mounted on the guide rail, the carriage containing a cutter wheel abutting the fixed blade and adapted to be turned, as the carriage is slid on the guide, by engagement of a friction drive wheel, coupled to the cutter wheel, with the upper surface of the guide rail, said guide rail including means for maintaining the axis of rotation of the cutter wheel at an acute angle relative to the plane of said board.

2. In a paper trimmer comprising a base board and fixed cutter blade set in one edge of the board, a guide rail mounted above and closely spaced from the cutter blade and a carriage mounted on the guide rail, the carriage containing an assembly of a cutter wheel coupled to a friction drive wheel, the cutter wheel abutting the fixed blade and adapted to be turned, as the carriage is slid on the guide, by engagement of the friction drive wheel with the upper surface of the guide rail, and means maintained by said carriage and acting, together with said guide rail, on said assembly for angularly displacing said assembly to a position, dependent upon the direction of movement of said carriage on said guide, in which the leading edge of the cutter wheel is in contact with the cutter blade and the trailing edge of the cutter wheel is spaced from the cutter blade.

3. The paper trimmer of claim 2 wherein said displacing means is adapted to bias the assembly of cutter wheel and drive wheel into one of two positions angularly symmetrical with respect to a plane perpendicular to the cutting edge of the cutting blade.

4. The paper trimmer of claim 3 wherein said displacing means comprises a spring positioned within said carriage, said spring being formed with two depressions therein, said depressions being adjacent to one another, each of said depressions being adapted to receive said drive wheel.

* * * * *